United States Patent [19]

Johnson

[11] 4,442,136

[45] Apr. 10, 1984

[54] ELECTROLUMINESCENT DISPLAY WITH LASER ANNEALED PHOSPHOR

[75] Inventor: Milo R. Johnson, Richardson, Tex.

[73] Assignee: Texas Instruments Incorporated, Dallas, Tex.

[21] Appl. No.: 354,113

[22] Filed: Mar. 2, 1982

[51] Int. Cl.[3] ..... B05D 3/06; B05D 5/12

[52] U.S. Cl. ..... 427/53.1; 313/509; 427/64; 427/108; 427/157

[58] Field of Search ..... 427/53.1, 64, 108, 157; 313/463, 509

[56] References Cited

U.S. PATENT DOCUMENTS

| | | | |
|---|---|---|---|
| 3,637,410 | 1/1972 | Stevens | 427/53.1 |
| 4,155,030 | 5/1979 | Chang | 313/463 X |
| 4,181,563 | 1/1980 | Miyaka et al. | 427/53.1 X |
| 4,188,565 | 2/1980 | Mizukami et al. | 313/509 |
| 4,213,074 | 7/1980 | Kawaguchi et al. | 313/509 |
| 4,242,370 | 12/1980 | Abdulla et al. | 427/64 X |

OTHER PUBLICATIONS

*Laser Focus,* Nov. 1981.

*Primary Examiner*—Michael R. Lusignan
*Attorney, Agent, or Firm*—Robert Groover; Melvin Sharp; James T. Comfort

[57] ABSTRACT

A method for producing AC-driven thin film electroluminescent displays, wherein the phosphor is laser annealed to enhance crystallinity. Preferably the phosphor is zinc fluoride, which has a relatively low melting point, facilitating low temperature processing.

14 Claims, 3 Drawing Figures

ELECTROLUMINESCENT DISPLAY WITH LASER ANNEALED PHOSPHOR

BACKGROUND OF THE INVENTION

The present invention relates to thin film electroluminescent displays.

The configuration of the thin film electroluminescent display (TFEL) to which the invention is directed is generally shown in FIG. 1. An electroluminescent phosphor is sandwiched between two dielectric layers. A transparent conductor and a back electrode are used to selectively address the individual pixels of the display.

A pre-eminent difficulty in the commercial application of thin film electroluminescent displays has been the high voltages which are typically required. Since electroluminescence is produced in the phosphor 10 only at an electric field strength of about a million volts per centimeter or more, the drive voltages which must be applied to the conductors and are quite high.

One of the factors which exacerbates the high voltage requirement is the fact that the electroluminescent phosphor must be made thick enough to be sufficiently luminous to provide an adequate signal-to-noise ratio in the display. That is, a TFEL display which was constructed with a very thin phosphor layer might permit lower drive voltages, but would also be so dim in its "on" condition that the device would not, in practice, be useful as a marketable display.

Typically, the drive voltages required in a TFEL display according to the prior art will be substantially higher than those used in plasma display panels, and may be as high as 200 volts or more. Such high display address voltages mean that the display driver circuits required are very expensive and are physically large. Thus, the majority of the cost of a TFEL display formed according to the present art is attributable to the cost of the very high voltage drivers required.

A further constraint on the design of TFEL displays is heat dissipation. Heat will normally be dissipated both in the phosphor and in the dielectric layers during operation of the device. If the heat dissipated is excessive, the phosphor temperature may rise to a level at which avalanche multiplication of carriers will take place under the very high electric fields applied, and catastrophic break-down promptly follows.

Thus, it is an object of the present invention to provide a thin film electroluminescent display incorporating a phosphor which provides a large luminance for a given electric field magnitude.

It is a further object of the present invention to provide a thin film electroluminescent display incorporating a phospor which has minimal heat dissipation for a given electric field magnitude.

It is a further object of the present invention to provide a thin film electroluminescent display incorporating a phosphor which has high luminance and low heat dissipation.

It is a further object of the present invention to provide a method for fabricating thin film electroluminescent displays in which the phosphor has high luminance and low heat generation.

Thermal annealing of thin-film electroluminescent phosphors has been used to enhance crystallinity. However, temperatures much above 500 degrees C. are impractical, since the normal substrate materials begin to soften.

Thus, it is a further object of the present invention to provide good quality annealing of electroluminescent phosphors without risking substrate softening.

BRIEF DESCRIPTION OF THE DRAWING

The present invention will be described with reference to the accompanying drawings, wherein.

DESCRIPTION OF THE PREFERRED EMBODIMENTS

Figure 1:
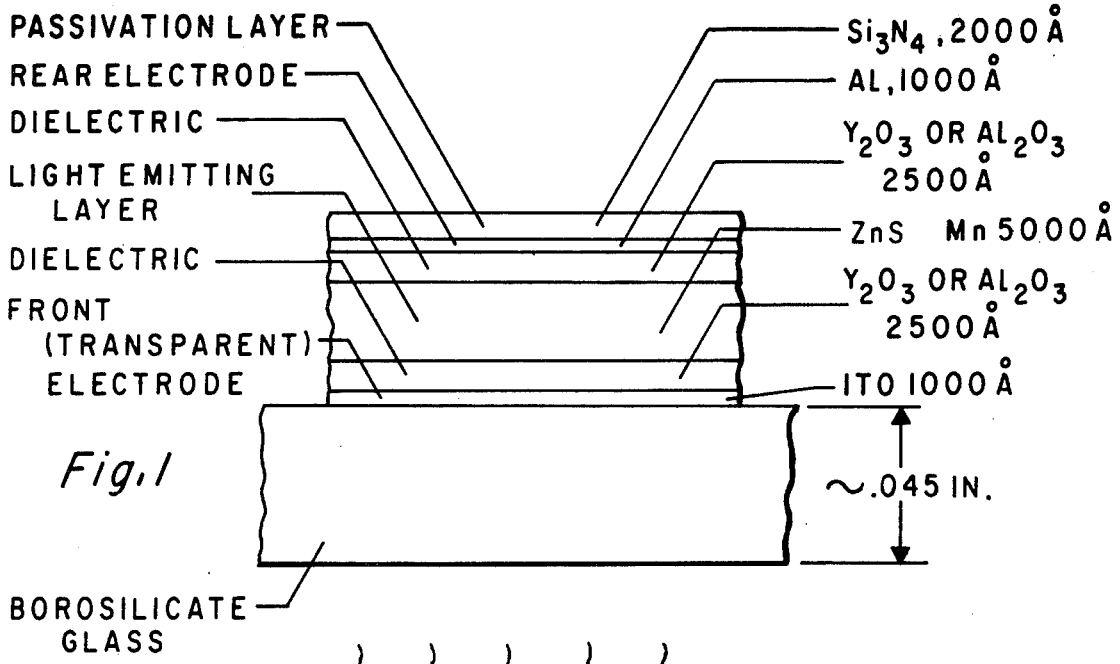
FIG. 1 shows the normal structure of a TFEL display device according to the prior art.

In AC-driven thin film electroluminescent (TFEL) film displays, a wide-gap semiconductor (semi-insulator) such as zinc sulfide or zinc fluoride, together with an activator such as manganese or terbium fluoride, is driven by a megavolt per centimeter electric field. This electric field induces impact ionization of the activator atoms (or clusters) by electrons.

The phosphor film as deposited is normally polycrystalline. Thus, the electron transport properties of the phosphor are limited by trapping and scattering at grain boundaries. If the electron mobility were improved, a lower applied voltage would be sufficient to induce electroluminescence. If the number of grain boundaries in the phosphor material could be reduced, the mobility would be increased as desired.

The present invention teaches annealing of the electroluminescent phophor material, to improve its crystallinity, thereby increasing its mobility, and thereby reduce the magnitude of the requisite applied electric field, so that lower drive voltages can be used to operate a TFEL device.

To anneal the phosphor to enhance its crystallinity, laser, electron beam, or even ion beam annealing can be used. The conventional method of improving cyrstallinity consists of thermal annealing at a steady temperature of about 500 degrees C. This annealing temperature is much lower than the melting temperature of the presently most popular candidate temperature of conventional annealing is limited by the softening temperature of the usual substrate material. (Borosilicate glass softens at about 570 degrees C.) However, the melting point of the presently most popular candidate phosphor material, zinc sulfide, is 1830 degrees, which means that annealing would require high temperature and/or high incident power density, which would make it difficult to usefully anneal a zinc sulfide phosphor without destroying the devices being formed.

For this purpose, zinc fluoride is much more attractive. Zinc fluoride activated with manganese is also known to be an efficient TFEL material. See Mortan and Williams, 35 Applied Physics Letters, 671 (1979), which is hereby incorporated by reference. The great advantage of zinc fluoride, in this case, is that its melting point is only 872 degrees centigrade. Even where it is not necessary to heat the material to melting for annealing, the lower melting point will also permit a lower recrystallization temperature. Note that the other materials which may be used in conjunction with a TFEL phosphor all have substantially higher melting points; e.g., yttria melts at 2410 degrees C., silica melts at 1610 degrees C., indium oxide melts at 1565 degrees C., and silicon melts at 1410 degrees C. Thus, one alternative embodiment of the invention applies laser annealing of the phosphor in situ after the device has already been fabricated.

An alternative way to regard the advantage of zinc fluoride is that, for the same annealing conditions, a greater improvement in grain size will be induced where zinc fluoride is the phosphor rather than zinc sulfide. The present invention may also be applied to other known electroluminescent phosphor materials, such as zinc selenide, gallium phosphide, etc.

Thus, the present invention teaches a transient annealing process, so that very substantial phosphor recrystallization can be obtained without substrate softening. Laser annealing is the most convenient way to achieve transient annealing with low average temperature.

An example of the application of the present invention to a thin film electroluminescent display with a zinc sulfide phosphor will now be described. Since the bandgap of zinc sulfide is 3.6 eV, a laser wavelength shorter than 344 nm is required if the light is to be absorbed in the zinc sulfide phosphor. Some of the attractive laser choices which may be used include helium-cadmium, at 325 nm; argon ion, at 330–360 nm; nitrogen, at 337 nm; and xenon chloride excimer, at 308 nm. Of these, the argon ion laser has by far the highest power output, easily 10 watts or better multi-mode.

It is noted that zinc sulfide films may be thermally annealed at temperatures of around 500 degrees C. with significant improvement in grain size. This is far below the melting point of zinc sulfide, as noted above. Annealing energy density of around 1 joule per square centimeter is therefore used, to provide some improvement in grain size without disastrous thermal effects. For a 5000 Angstrom zinc sulfide film thickness, an argon ion laser can be used with a spot size of 80 microns diameter, a power of around 150 milliwatts (producing a power density of the order of several thousand watts per centimeter squared) and a scan speed of 20 centimeters per second, producing approximately a 1 Joule per square centimeter energy density. The power density is selected in the range of several hundred to ten thousand watts per square cm. The energy density is selected in the range of one tenth to several Joules per square cm.

Figure 2:
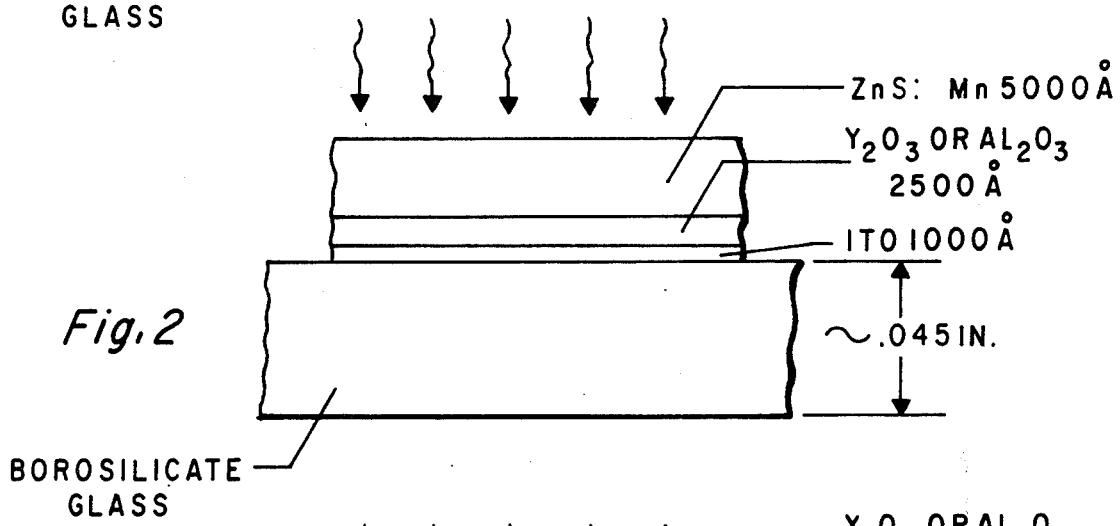
FIG. 2 shows laser annealing according to the present invention, in an inert atmosphere.
Figure 3:
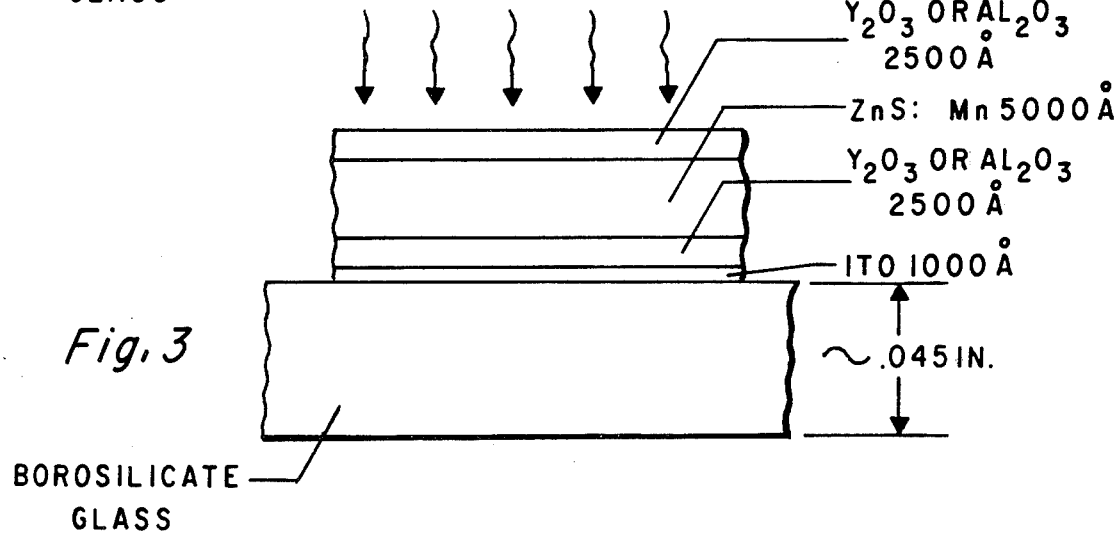
FIG. 3 shows laser annealing of an encapsulated TFEL device phosphor.

Since the borosilicate glass substrate which is preferably used is not transmissive at the laser wavelength, it is necessary to apply the light from the opposite direction. FIGS. 2 and 3 show two possible configurations for annealing. Note that in FIG. 1 the phosphor is not capped, and the device being annealed must therefore be in an inert atmosphere (e.g. argon) to prevent ablation. FIG. 3 shows a configuration where the dielectric layers have both been deposited before annealing begins. Since the dielectrics (e.g. yttria) have larger energy gap than the zinc sulfide, they will not absorb the laser radiation. Thus, the dielectric layers tend to confine the heated zinc sulfide.

As noted above, the same sequence of process steps is alternatively be applied to zinc fluoride, with even better results.

Note also that the dopant used may be varied, since the principle object of the annealing process used in the present invention is to affect the mobility characteristics of the phosphor itself.

A further advantage of the anealing process is that the resulting phosphor has better dielectric qualities. That is, the annealed phosphor has a lower loss coefficient. Thus, less heat is generated in the phosphor, and the danger of thermal runaway is averted.

To further reduce the requisite applied drive voltage, the present invention may be used in combination with that taught by simultaneously-filed application Ser. No. 353,991filed Mar. 2, 1982, of common assignee, which is hereby incorporated by reference. That application teaches use of a composite dielectric material, including both a high-dielectric-constant material (such as titanium dioxide) and a low-dielectric-loss material (such as alumina), for the two dielectric layers which isolate the active phosphor layer.

Further references regarding TFEL displays, all of which are hereby incorporated by reference, include *Electroluminescence* (ed. J. Pankove, 1977); Hurd & King, Physical and Electrical Characterization of Co-Deposited ZnS:Mn Electroluminescent Thin Film Structures, 8 J. Electronic Materials 879 (1979); Tanaka et al, Evidence for the Direct Impact Excitation of Mn Centers in Electroluminescent ZnS:Mn Films, 47 J. Applied Physics 5391 (1976); Krupka, Hot-Electron Impact Excitation of Tb+++Luminescence in ZnS:Tb+++Thin Films, 43 J. Applied Physics 476 (1972).

To employ the present invention in fabrication of operational TFEL display devices, further conventional fabrication steps, as taught by the above references, are used. For example: (1) a transparent substrate, such as borosilicate glass, is provided; (2) a first (transparent) conductor (such as indium tin oxide) is applied in a pattern of parallel lines; (3) a first dielectric layer (such as yttria) is applied; (4) an electroluminescent phosphor incorporating an activator, such as ZnS:Mn, is applied; (5) a second dielectric (such as yttria) is applied in a layer; (6) a second conductor is applied in parallel lines which are octogonal to those of the first conductor; and (7) an encapsulating layer is applied. The radiant annealing process of the present invention may be applied at any time after step 4.

What is claimed is:

1. A process for fabricating thin film electroluminescent displays, comprising the steps of:

providing a transparent substrate;

providing a patterned transparent conductor on said substrate;

providing a first continuous dielectric layer on said pattern conductor;

providing a phosphor layer on said first dielectric layer; and transiently annealing said phosphor to induce recrystallization therein.

2. The process of claim 1, further comprising the step of applying a second uniform dielectric layer on said phosphor, prior to said step of annealing.

3. The process of claim 1, further comprising the step of:

providing an inert atmosphere in contact with said phosphor, during said step of annealing.

4. The process of claim 1, 2, or 3, wherein said annealing step comprises laser annealing.

5. The process of claim 1, 2, or 3 wherein said phosphor comprises zinc fluoride.

6. The process of claim 4, wherein said phosphor comprises zinc fluoride.

7. The process of claim 4, wherein said phosphor comprises zinc sulfide.

8. The process of claim 1, 2, or 3, wherein said phosphor layer has a melting point below 1200 degrees C.

9. The process of claim 4, wherein said phosphor layer has a melting point below 1200 degrees C.

10. The process of claim 1 or 2, wherein each said dielectric layer comprises a composite of a first material having a high dielectric constant and a second material having a low dielectric loss.

11. The process of claim 10, wherein said first material is titanium dioxide and said second material is alumina.

12. The process of claim 1, wherein said annealing step is applied to substantially all of said phosphor.

13. The process of claim 1, wherein said substrate comprises borosilicate glass.

14. The process of claim 6, wherein said substrate comprises borosilicate glass.

* * * * *